US008555713B2

(12) United States Patent
Sasaki

(10) Patent No.: US 8,555,713 B2
(45) Date of Patent: Oct. 15, 2013

(54) COIN RECOGNIZING DEVICE AND COIN RECOGNIZING METHOD

(75) Inventor: Tomoyuki Sasaki, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 423 days.

(21) Appl. No.: 12/736,353

(22) PCT Filed: Apr. 2, 2008

(86) PCT No.: PCT/JP2008/056595

§ 371 (c)(1),
(2), (4) Date: Sep. 30, 2010

(87) PCT Pub. No.: WO2009/122576

PCT Pub. Date: Oct. 8, 2009

(65) Prior Publication Data

US 2011/0016965 A1 Jan. 27, 2011

(51) Int. Cl.
*G07D 5/00* (2006.01)

(52) U.S. Cl.
USPC ..... 73/163

(58) Field of Classification Search
USPC ..... 73/163
See application file for complete search history.

(56) References Cited

U.S. PATENT DOCUMENTS

| | | | | |
|---|---|---|---|---|
| 4,556,140 | A | 12/1985 | Okada | 194/4 |
| 5,167,313 | A * | 12/1992 | Dobbins et al. | 194/317 |
| 7,014,029 | B2 * | 3/2006 | Winters | 194/302 |

FOREIGN PATENT DOCUMENTS

| | | | |
|---|---|---|---|
| EP | 1 004 991 | A2 | 5/2000 |
| GB | 2 315 149 | A | 1/1998 |
| JP | 04-098591 | | 3/1992 |
| JP | 07-105424 | | 4/1995 |
| JP | 2003-256902 | | 9/2003 |
| JP | 2008-135067 | | 6/2008 |
| WO | WO 97/27567 | | 7/1997 |
| WO | WO 2004/063995 | A2 | 7/2004 |

OTHER PUBLICATIONS

International Search Report (dated Jul. 15, 2008—2 pages).
European Supplementary Search Report (dated May 19, 2011—6 pages).

* cited by examiner

*Primary Examiner* — Hezron E Williams
*Assistant Examiner* — Gregory J Redmann
(74) *Attorney, Agent, or Firm* — Renner, Kenner, Greive, Bobak, Taylor & Weber

(57) ABSTRACT

A coin recognizing device is configured in which a main-judgment-frame registration unit registers main judgment frames for each denomination including value ranges corrected so that a value range corresponding to data of at least one of recognition elements does not overlap with a value range corresponding to the same recognition element of any other denominations, an auxiliary-judgment-frame registration unit registers auxiliary judgment frames for a specific denomination including value ranges of the recognition elements of a coin of which data does not fall within the main judgment frames for the specific denomination but is to be judged as a coin of the specific denomination, and a judging unit judges a coin of which data falls within either the main judgment frames or the auxiliary judgment frames and does not fall into the reject judgment frames as a coin of a denomination corresponding to the main judgment frame.

13 Claims, 12 Drawing Sheets

(1) REGISTER THREE TYPES OF CHANGEABLE JUDGMENT FRAMES (2) RECOGNIZE COIN BY USING JUDGMENT FRAMES

FIG.1
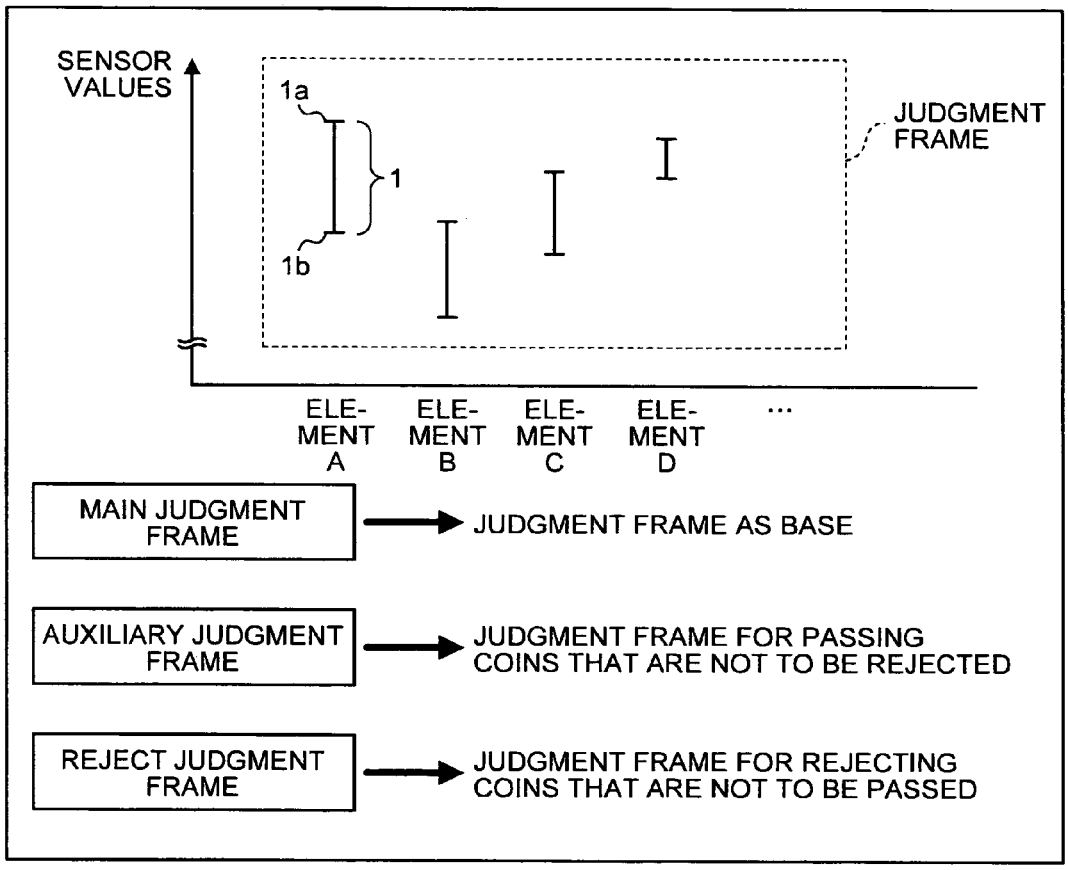
(1) REGISTER THREE TYPES OF CHANGEABLE JUDGMENT FRAMES
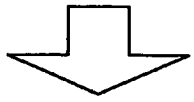
(2) RECOGNIZE COIN BY USING JUDGMENT FRAMES

FIG.5

| MAIN JUDGMENT | ELEMENT A | | ELEMENT B | | ELEMENT C | | ··· |
|---|---|---|---|---|---|---|---|
| | HIGHER LIMIT | LOWER LIMIT | HIGHER LIMIT | LOWER LIMIT | HIGHER LIMIT | LOWER LIMIT | |
| DENOMI-NATION α | αAH | αAL | αBH | αBL | αCH | αCL | ··· |
| DENOMI-NATION β | βAH | βAL | βBH | βBL | βCH | βCL | ··· |
| DENOMI-NATION γ | γAH | γAL | γBH | γBL | γCH | γCL | ··· |
| ⋮ | ⋮ | ⋮ | ⋮ | ⋮ | ⋮ | ⋮ | ··· |

FIG.6
(1)
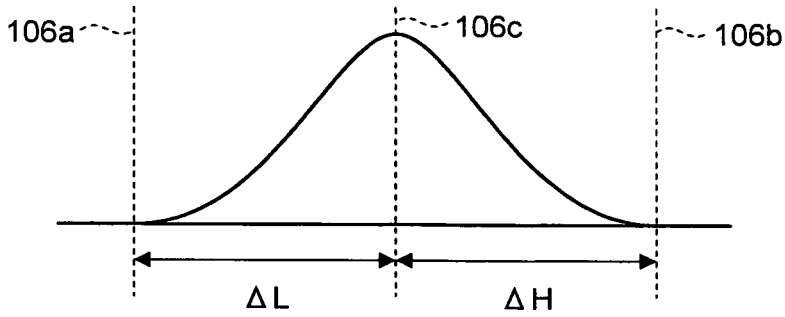
(2)
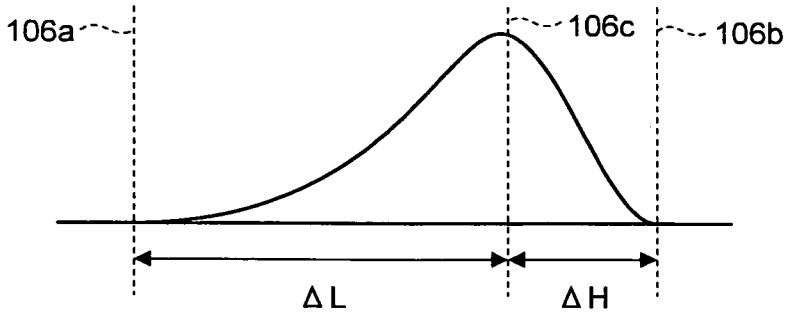
(3)
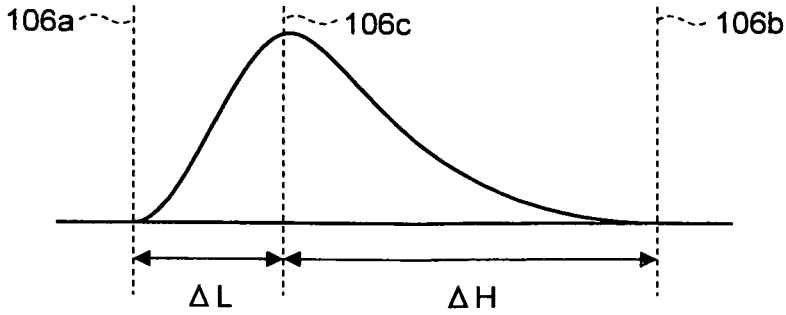

FIG.8

| AUXILIARY JUDGMENT | ELEMENT A | | ELEMENT B | | ELEMENT C | | ... | VALID FLAG |
|---|---|---|---|---|---|---|---|---|
| | HIGHER LIMIT | LOWER LIMIT | HIGHER LIMIT | LOWER LIMIT | HIGHER LIMIT | LOWER LIMIT | | |
| JUDGMENT 1 | 1SAH | 1SAL | 1SBH | 1SBL | 1SCH | 1SCL | ··· | ON |
| JUDGMENT 2 | 2SAH | 2SAL | 2SBH | 2SBL | 2SCH | 2SCL | ··· | ON |
| JUDGMENT 3 | 3SAH | 3SAL | 3SBH | 3SBL | 3SCH | 3SCL | ··· | ON |
| ⋮ | ⋮ | ⋮ | ⋮ | ⋮ | ⋮ | ⋮ | ⋮ | ⋮ |

| REJECT JUDGMENT | ELEMENT A | | ELEMENT B | | ELEMENT C | | ... | VALID FLAG |
|---|---|---|---|---|---|---|---|---|
| | HIGHER LIMIT | LOWER LIMIT | HIGHER LIMIT | LOWER LIMIT | HIGHER LIMIT | LOWER LIMIT | | |
| JUDGMENT 1 | 1EAH | 1EAL | 1EBH | 1EBL | 1ECH | 1ECL | ··· | ON |
| JUDGMENT 2 | 2EAH | 2EAL | 2EBH | 2EBL | 2ECH | 2ECL | ··· | OFF |
| JUDGMENT 3 | 3EAH | 3EAL | 3EBH | 3EBL | 3ECH | 3ECL | ··· | OFF |
| ⋮ | ⋮ | ⋮ | ⋮ | ⋮ | ⋮ | ⋮ | ⋮ | ⋮ |

FIG.11

| AUXILIARY JUDGMENT | ELEMENT A | | ELEMENT B | | ELEMENT C | | ... | VALID FLAG |
|---|---|---|---|---|---|---|---|---|
| | HIGHER LIMIT | LOWER LIMIT | HIGHER LIMIT | LOWER LIMIT | HIGHER LIMIT | LOWER LIMIT | | |
| JUDGMENT 1 | 1AH | 1AL | 1BH | 1BL | 1CH | 1CL | ··· | ON |
| JUDGMENT 2 | 2AH | 2AL | 2BH | 2BL | 2CH | 2CL | ··· | ON |
| JUDGMENT 3 | 3AH | 3AL | 3BH | 3BL | 3CH | 3CL | ··· | ON |
| ⋮ | ⋮ | ⋮ | ⋮ | ⋮ | ⋮ | ⋮ | ⋮ | ⋮ |

COIN RECOGNIZING DEVICE AND COIN RECOGNIZING METHOD

TECHNICAL FIELD

The present invention relates to a coin recognizing device and a coin recognizing method for recognizing a coin based on whether a plurality of elements according to sensor outputs are included in predetermined value ranges, respectively, and more particularly to a coin recognizing device and a coin recognizing method that enable to handle coins of various countries and to flexibly address additions or changes of recognition targets.

BACKGROUND ART

A coin recognizing device that recognizes a denomination or authentication of a coin checks various elements such as a diameter, a material, a design, and a thickness of the coin as a recognition target according to outputs from a magnetic sensor or an optical sensor. This check is performed by judging whether sensor outputs corresponding to the elements of a genuine coin are included in predetermined value ranges (hereinafter, a set of value ranges to be used for the judgment is referred to as "judgment frame"). A coin recognizing device that judges a denomination by using a judgment frame is disclosed in Patent Document 1, for example.

In the coin recognition by using the judgment frame, for example when all sensor output values are included in value ranges of a specific judgment frame, respectively, a coin is judged to be a genuine one of a denomination corresponding to the judgment frame. The judgment frame having a set of predetermined value ranges is used because even genuine coins have individual differences and also the sensors have individual differences. This is also because the respective sensor outputs vary between new coins that have recently been released and circulated coins that have already been circulated in the market. Therefore, when the judgment frame having a set of predetermined value ranges is used, erroneous rejection of a genuine coin can be prevented.

Collection of samples with large amounts of new coins and circulated coins is required to create the judgment frame for each denomination. For example, when recognition targets are Japanese coins, it is easy to acquire new coins and circulated coins in Japan. Therefore, there is no particular problem in creating judgment frames previously when a coin recognizing device is developed, or re-creating a new judgment frame when a new coin is released.

Patent Document 1: Japanese Patent Application Laid-open No. 2003-256902

DISCLOSURE OF INVENTION

Problem to be Solved by the Invention

However, when a coin recognizing device that recognizes coins of other countries is to be developed, it is difficult to acquire large amounts of new coins and circulated coins of the countries at the time of development of the coin recognizing device, and therefore creation of judgment frames itself is difficult.

After introduction of the coin recognizing device, when a pass rate (a rate at which genuine coins are judged to be genuine) is reduced or when rejection targets are increased due to appearance of a new forged coin or the like, such an event needs to be promptly handled. However, in the conventional method using the judgment frame, change of the judgment frame cannot be performed easily and a prompt action is difficult.

For this reason, how a coin recognizing device or a coin recognizing method realizes handling coins of various countries and also flexibly addressing addition or change of a recognition target while performing the coin recognition using the judgment frame has been a major issue.

The present invention has been achieved to solve the problem of the conventional technique, and it is an object of the present invention to provide a coin recognizing device and a coin recognizing method that enable to handle coins of various countries and also to flexibly address addition or change of a recognition target while performing the coin recognition using the judgment frame.

Means for Solving Problem

To solve the problems described above and achieve the object, the present invention is a coin recognizing device for recognizing a coin based on whether data of a plurality of recognition elements of the coin according to sensor outputs are included in predetermined value ranges, respectively. The coin recognizing device includes a main-judgment-frame registration unit for registering a main judgment frame for each denomination including the value ranges that are corrected so that the value range corresponding to at least one of the recognition elements does not overlap with the value range corresponding to the same recognition element of any other denominations; an auxiliary-judgment-frame registration unit for registering an auxiliary judgment frame for each denomination including the value ranges of the recognition elements of a coin of which data does not fall within the main judgment frame but is to be judged as that of a specific denomination; and a judging unit for judging a coin of which data falls within the main judgment frame or the auxiliary judgment frame as a coin of a denomination corresponding to the main judgment frame.

The present invention is a coin recognizing device for recognizing a coin based on whether data of a plurality of recognition elements of the coin according to sensor outputs are included in predetermined value ranges, respectively. The coin recognizing device includes a main-judgment-frame registration unit for registering a main judgment frame for each denomination including the value ranges that are corrected so that the value range corresponding to at least one of the recognition elements does not overlap with the value range corresponding to the same recognition element of any other denominations; a reject-judgment-frame registration unit for registering a reject judgment frame for each denomination including the value ranges of the recognition elements of a coin of which data falls within the main judgment frame but that is not to be judged as that of a specific denomination; and a judging unit for judging a coin of which data falls within the main judgment frame and does not fall within the reject judgment frame as a coin of a denomination corresponding to the main judgment frame.

The present invention is a coin recognizing device for recognizing a coin based on whether data of a plurality of recognition elements of the coin according to sensor outputs are included in predetermined value ranges, respectively. The coin recognizing device includes a main-judgment-frame registration unit for registering a main judgment frame for each denomination including the value ranges that are corrected so that the value range corresponding to a distribution of data of at least one of the recognition elements does not overlap with the value range corresponding to that of the same recognition element of any other denominations; an auxiliary-judgment-frame registration unit for registering an auxiliary judgment frame for each denomination including the value ranges of the recognition elements for a coin of which data does not fall within the main judgment frame but that is to be judged as a coin of a specific denomination; a reject-judgment-frame registration unit for registering a reject judgment frame for each denomination including the value ranges of the recognition elements for a coin of which data falls within the main judgment frame of a specific denomination or the auxiliary judgment frame of the specific denomination but that is not to be judged as a coin of the specific denomination; and a judging unit for judging a coin of which data falls within either the main judgment frame or the auxiliary judgment frame and does not fall within the reject judgment frame as a coin corresponding to the main judgment frame.

In the present invention, when all of the value ranges corresponding to respective recognition elements of the specific denomination overlap with all of the respective value ranges corresponding to the same respective recognition elements of any other denominations, the main-judgment-frame registration unit performs correction so as to determine one recognition element of which the data distributions are the most distant from each other between the specific denomination and any of the overlapping denomination, and to correct so that at least any one of the value ranges of the most distant element of the overlapping denominations do not overlap each other.

In the present invention, when the value range corresponding to a specific recognition element is corrected by the main-judgment-frame registration unit not to overlap with the value range corresponding to the same recognition element of any other denominations, the auxiliary-judgment-frame registration unit registers the auxiliary judgment frame having the value range that has been overlapped before the correction as a value range related to the specific recognition element, and having ranges of respective data of other recognition elements included in the value ranges as value ranges related to the other recognition elements.

In the present invention, the auxiliary-judgment-frame registration unit is capable of registering a plurality of the auxiliary judgment frames for each denomination, and the reject-judgment-frame registration unit is capable of registering a plurality of the reject judgment frames for each denomination.

In the present invention, when the plural auxiliary judgment frames or the plural reject judgment frames are registered for each denomination, the auxiliary judgment frames or the reject judgment frames are compared with each other, and when value ranges corresponding to any recognition element have an overlapped part of data or are next to each other with respect to each of all the recognition elements, integration is performed to combine relevant judgment frames into one judgment frame having a continuous value range.

The present invention is a coin recognizing method for recognizing a coin based on whether data of a plurality of recognition elements according to sensor outputs are included in predetermined value ranges, respectively. The coin recognizing method includes a main-judgment-frame registration step of registering a main judgment frame for each denomination including the value ranges that are corrected so that the value range corresponding to at least one of the recognition elements does not overlap with the value range corresponding to the same recognition element of any other denominations; an auxiliary-judgment-frame registration step of registering an auxiliary judgment frame for each denomination including the value ranges of the recognition elements for a coin of which data does not fall within the main judgment frame but that is to be judged as a coin of a specific denomination; and a judging step of judging a coin of which data falls within the main judgment frame or the auxiliary judgment frame as a coin of a denomination corresponding to the main judgment frame.

The present invention is a coin recognizing method for recognizing a coin based on whether data of a plurality of recognition elements according to sensor outputs are included in predetermined value ranges, respectively. The coin recognizing method includes a main-judgment-frame registration step of registering a main judgment frame for each denomination including the value ranges that are corrected so that the value range corresponding to at least one of the recognition elements does not overlap with the value range corresponding to the same recognition element of any other denominations; a reject-judgment-frame registration step of registering a reject judgment frame for each denomination including the value ranges of the recognition elements for a coin of which data falls within the main judgment frame but that is not to be judged as a coin of a specific denomination; and a judging step of judging a coin of which data falls within the main judgment frame and does not fall within the reject judgment frame as the coin of a denomination corresponding to the main judgment frame.

The present invention is a coin recognizing method for recognizing a coin based on whether data of a plurality of recognition elements according to sensor outputs are included in predetermined value ranges, respectively. The coin recognizing method includes a main-judgment-frame registration step of registering a main judgment frame for each denomination including the value ranges that are corrected so that the value range corresponding to at least one of the recognition elements does not overlap with the value range corresponding to the same recognition element of any other denominations; an auxiliary-judgment-frame registration step of registering an auxiliary judgment frame for each denomination including the value ranges of the recognition elements for a coin of which data does not fall within the main judgment frame but that is to be judged as a coin of a specific denomination; a reject-judgment-frame registration step of registering a reject judgment frame for each denomination including the value ranges of the recognition elements for a coin of which data falls within the main judgment frame or the auxiliary judgment frame but that is not to be judged as a coin of a specific denomination; and a judging step of judging a coin of which data falls within either the main judgment frame or the auxiliary judgment frame and does not fall within the reject judgment frame as a coin corresponding to the main judgment frame.

Effect of the Invention

According to the present invention, the main judgment frame including the value ranges that are corrected so that the value range corresponding to at least one of the recognition elements does not overlap with the value range corresponding to the same recognition element of any other denominations is registered for each denomination, the auxiliary judgment frame including the value ranges of the recognition elements for a coin of which data does not fall within the main judgment frame but is to be judged as that of a specific denomination is registered for each denomination, and a coin of which data falls within the main judgment frame or the auxiliary judgment frame is judged as a coin corresponding to the main judgment frame. Therefore, by using the main judgment frame, and the auxiliary judgment frame for passing coins that are rejected by the main judgment frame but are originally not to be rejected, coins of various countries can be handled, and addition or change of recognition targets can be flexibly addressed.

According to the present invention, the main judgment frame including the value ranges that are corrected so that the value range corresponding to at least one of the recognition elements does not overlap with the value range corresponding to the same recognition element of any other denominations is registered for each denomination, a reject judgment frame including the value ranges of the recognition elements for a coin of which data falls within the main judgment frame but is not to be judged as that of a specific denomination is registered for each denomination, and a coin of which data falls within the main judgment frame and does not fall within the reject judgment frame is judged as a coin of a denomination corresponding to the main judgment frame. Therefore, by using the main judgment frame, and the reject judgment frame for rejecting coins that are not rejected by the main judgment frame but are originally to be rejected, coins of various countries can be handled, and addition or change of recognition targets can be flexibly addressed.

According to the present invention, the main judgment frame including the value ranges that are corrected so that the value range corresponding to at least one of the recognition elements does not overlap with the value range corresponding to that of the same recognition element of any other denominations is registered for each denomination, the auxiliary judgment frame including the value ranges of the recognition elements for a coin of which data does not fall within the main judgment frame but is to be judged as a coin of a specific denomination is registered for each denomination, the reject judgment frame including the value ranges of the recognition elements for a coin of which data falls into the main judgment frame or the auxiliary judgment frame but that is not to be judged as a coin of the specific denomination is registered for each denomination, and a coin of which data falls within either the main judgment frame or the auxiliary judgment frame and does not fall within the reject judgment frame is judged as a coin corresponding to the main judgment frame. Therefore, by using the auxiliary judgment frame for passing coins that are rejected by the main judgment frame but are originally not to be rejected, and the reject judgment frame for rejecting coins that are not rejected by the main judgment frame or the auxiliary judgment frame but are originally to be rejected, coins of various countries can be handled, and addition or change of recognition targets can be flexibly addressed.

According to the present invention, when the value ranges corresponding to all the recognition elements overlap with the value ranges corresponding to the same respective recognition elements of any other denominations, correction is performed so as to determine one recognition element of which the data distributions are the most distant from each other between the specific denomination and any of the overlapping denomination. Therefore, by performing the correction so that the main judgment frames do not overlap with each other with respect to a recognition element that tends to have a largest difference, the main judgment frames corresponding to respective denominations can be separately registered.

According to the present invention, when the value range corresponding to a specific recognition element is corrected not to overlap with the value range corresponding to the same recognition element of any other denominations, an auxiliary judgment frame having the value range that has been overlapped before adjustment as a value range related to the specific recognition element, and having ranges of respective data for other recognition elements included in the value range as value ranges related to the other recognition elements is registered. Therefore, when correction is performed so that specific recognition elements in the overlapped main range frames do not overlap with each other, a set of value ranges for each recognition element that can be taken by respective data corresponding to a corrected part is automatically registered in an auxiliary judgment frame. Accordingly, coins corresponding to the corrected part of the main judgment frame can be passed by the auxiliary judgment frame corresponding to the main judgment frame.

According to the present invention, a plurality of the auxiliary judgment frames can be registered for each denomination, and a plurality of the reject judgment frames can be registered for each denomination. Therefore, cases where new counterfeit coins appear or qualities of circulated coins change can be also flexibly addressed.

According to the present invention, when the plural auxiliary judgment frames or the plural reject judgment frames are registered for each denomination, the auxiliary judgment frames or the reject judgment frames are compared with each other. When the value ranges corresponding to each recognition element have an overlapped part or are next to each other with respect to all the recognition elements, integration is performed to combine relevant judgment frames into one judgment frame having a contiguous value range. Therefore, a memory capacity corresponding to the auxiliary judgment frames or the reject judgment frames can be reduced, and a judging process can be speeded up.

BRIEF DESCRIPTION OF DRAWINGS

FIG. 1 depicts an overview of a coin recognizing method according to the present invention.

FIG. 5 is an example of a main judgment frame.

FIG. 6 depicts examples of a distribution of sensor values.

FIG. 8 depicts examples of the auxiliary judgment frame and a reject judgment frame.

FIG. 11 is an explanatory diagram of integration of judgment frames.

EXPLANATIONS OF LETTERS OR NUMERALS

Figure 2:
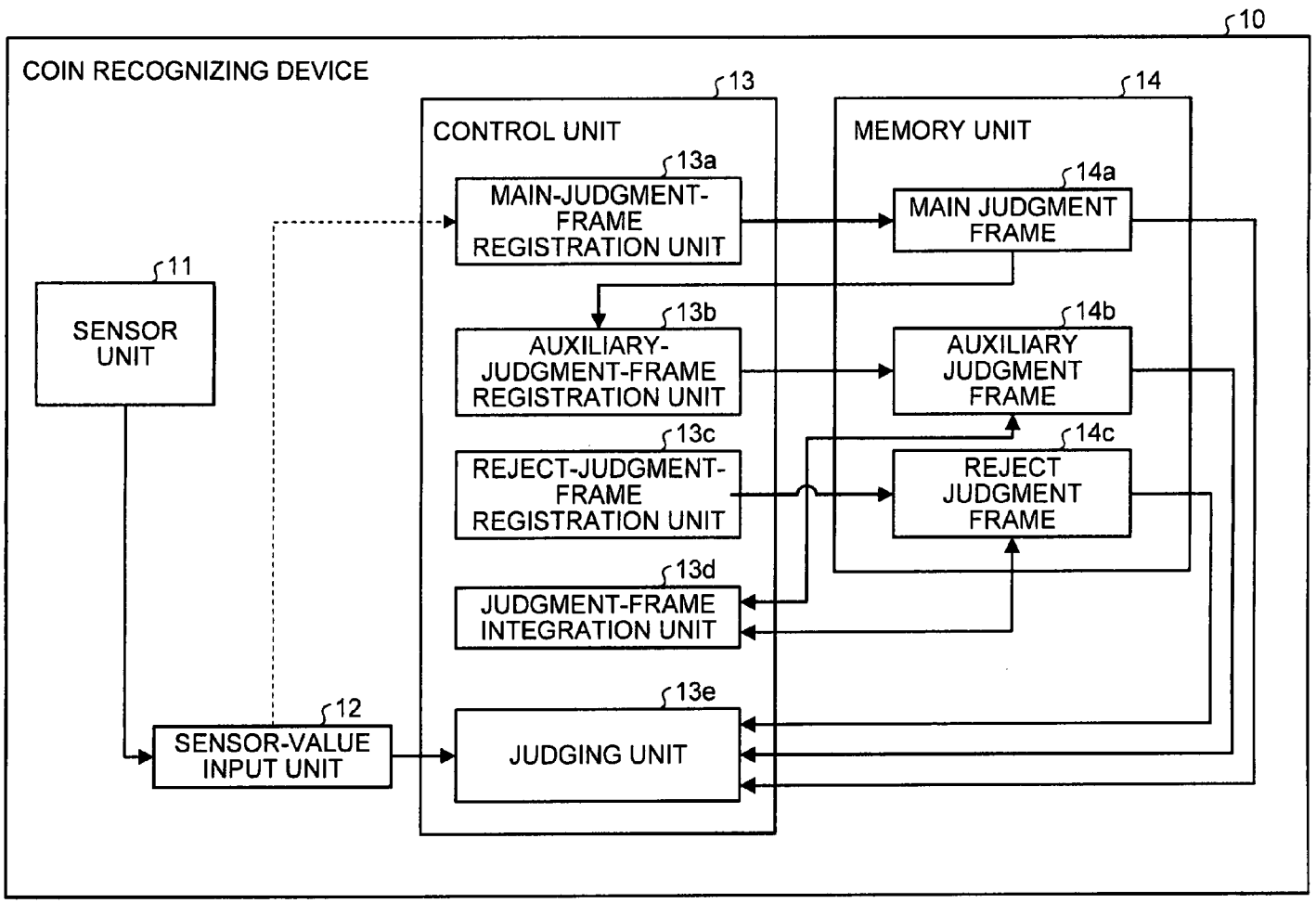
FIG. 2 is a block diagram of a configuration of a coin recognizing device according to an embodiment of the present invention.

1 Value range
1*a* Higher limit value
1*b* Lower limit value
10 Coin recognizing device
11 Sensor unit
11*ca*, 11*cb*, 11*cc* Sensor
11*da*, 11*db*, 11*dc* Waveform shaping circuit
11*e* A/D converter
12 Sensor-value input unit

13 Control unit
13*a* Main-judgment-frame registration unit
13*b* Auxiliary-judgment-frame registration unit
13*c* Reject-judgment-frame registration unit
13*d* Judgment-frame integration unit
13*e* Judging unit
14 Memory unit
14*a* Main judgment frame
14*b* Auxiliary judgment frame
14*c* Reject judgment frame
100 Coin
200 Lower surface of transport path
300 Transport belt

BEST MODE(S) FOR CARRYING OUT THE INVENTION

Exemplary embodiments of a coin recognizing method according to the present invention will be explained below in detail with reference to the drawings. An overview of the coin recognizing method according to the present invention is explained below with reference to FIG. 1, and then an embodiment of a coin recognizing device applied with the coin recognizing method according to the present invention is explained with reference to FIGS. 2 to 12.

FIG. 1 depicts an overview of the coin recognizing method according to the present invention. As shown in FIG. 1, "judgment frame" indicates a set of allowable value ranges 1 (between a lower limit value 1*b* and a higher limit value 1*a*) for each recognition element (hereinafter, simply "element") of a sensor value with respect to each denomination. For example, value ranges for elements B to D are set as well as the value range 1 for an element A as shown in FIG. 1. When all sensor values are included in the respective value ranges for the elements, a coin is judged as a denomination corresponding to the judgment frame. The elements include a diameter, a material, a thickness, irregularity, the number of lines of a milled edge, hole information, and bimetal information, for example. The number of the elements is not particularly limited.

A main characteristic of the coin recognizing method according to the present invention is in performing coin recognition by using judgment frames including a main judgment frame, an auxiliary judgment frame, and a reject judgment frame, as shown in FIG. 1. The main judgment frame is a judgment frame as a base, and the auxiliary judgment frame is a judgment frame for passing coins that are rejected by the main judgment frame but are originally not to be rejected. The reject judgment frame is a judgment frame for rejecting coins that are passed by the main judgment frame or the auxiliary judgment frame but are originally not to be passed.

One or more auxiliary judgment frames and one or more reject judgment frames are associated with the main judgment frame corresponding to a specific denomination. As many sets of the judgment frames as the denominations are prepared. As described above, in the coin recognizing method according to the present invention, three types of changeable judgment frames are registered (see (1) in FIG. 1), and coin recognition is performed by using these judgment frames (see (2) in FIG. 1). That is, conditions on coins that are exceptionally allowed to pass or coins that are exceptionally rejected are defined as the auxiliary judgment frame or the reject judgment frame while using the main judgment frame as the base. In this way, addition or change of a recognition target, or change of recognition details can be flexibly addressed.

In the coin recognizing method according to the present invention, when the main judgment frames overlap with each other, for example when a main judgment frame for a denomination A and a main judgment frame for a denomination B overlap with each other with respect to all elements, correction is performed to correct the main judgment frames not to overlap with each other with respect to a predetermined element. An auxiliary judgment frame for judging coins of the denomination A included in an overlapped part with respect to the adjusted element, and an auxiliary judgment frame for judging coins of the denomination B are automatically generated. Details thereof are explained later with reference to FIG. 7. An embodiment of a coin recognizing device adopting the coin recognizing method according to the present invention shown in FIG. 1 is explained below with reference to FIGS. 2 to 12.

Embodiment

FIG. 2 is a block diagram of a configuration of a coin recognizing device 10 according to the present embodiment. Only constituent elements required to explain characteristics of the coin recognizing device 10 are shown in FIG. 2, and descriptions of a transport mechanism for coins and the like will be omitted.

As shown in FIG. 2, the coin recognizing device 10 includes a sensor unit 11, a sensor-value input unit 12, a control unit 13, and a memory unit 14. The control unit 13 includes a main-judgment-frame registration unit 13*a*, an auxiliary-judgment-frame registration unit 13*b*, a reject-judgment-frame registration unit 13*c*, a judgment-frame integration unit 13*d*, and a judging unit 13*e*. The memory unit 14 stores a main judgment frame 14*a*, an auxiliary judgment frame 14*b*, and a reject judgment frame 14*c*.

Figure 3:
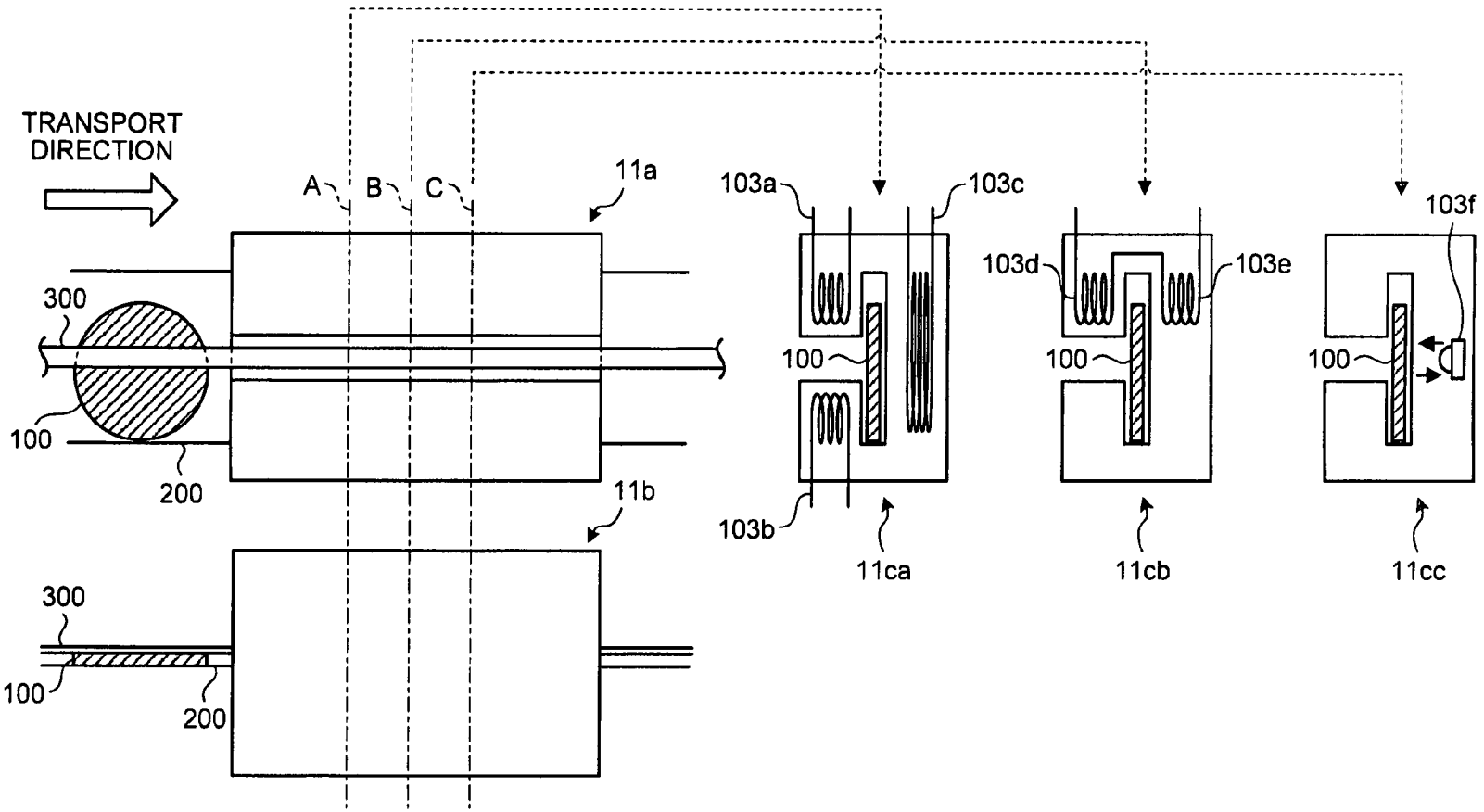
FIG. 3 is an example of a configuration of a sensor unit.

The sensor unit 11 is a group of sensors provided on a transport path on which coins are transported, and performs a process of transmitting sensor values obtained at passage of a coin to the sensor-value input unit 12. The sensor unit 11 is explained in detail with reference to FIGS. 3 and 4. FIG. 3 is an example of a configuration of the sensor unit 11. In FIG. 3, reference numeral 11*a* denotes a top view of the sensor unit 11, 11*b* denotes a side view of the sensor unit 11, and 11*ca*, 11*cb*, and 11*cc* denote section views of the sensor unit 11 along lines A, B, and C shown in FIG. 3, respectively.

As shown in FIG. 3, a coin 100 as a recognition target is transported by a transport belt 300 in a state where the coin is pressed on a lower surface 200 of the transport path. Sensor values are obtained by the sensors included in the sensor unit 11 while the coin 100 passes through the sensor unit 11. For example, sensors that detect a diameter of the coin 100 with combinations of coils 103*a* and 103*c*, and coils 103*b* and 103*c* are shown by 11*ca* of FIG. 3.

A sensor that detects a material or a thickness of the coin 100 with a combination of coils 103*d* and 103*e* is shown by 11*cb* of FIG. 3. A sensor that detects reflectivity or the like of the coin 100 with a light receiving/emitting element 103*f* is shown by 11*cc* of FIG. 3. The sensors shown in FIG. 3 are merely examples and other types of sensors can be used. The number of sensors is not particularly limited, and a combination of values detected by the sensors can be used as a sensor value.

Figure 4:
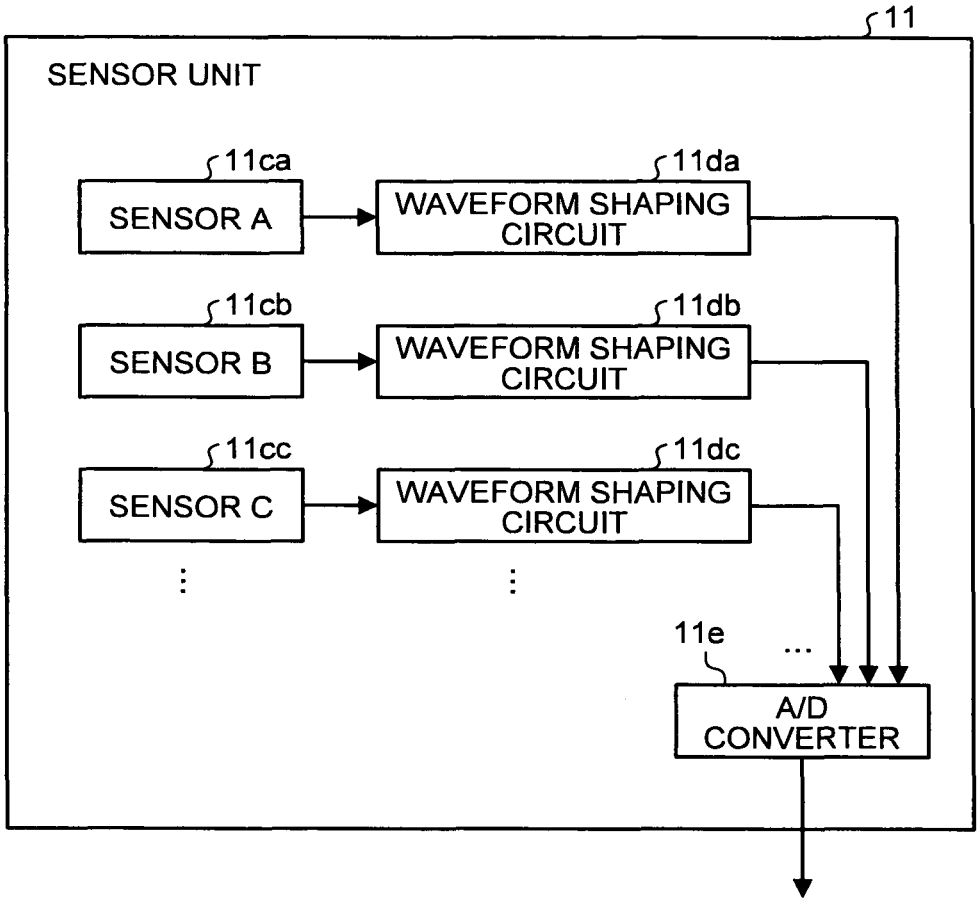
FIG. 4 is a block diagram of a configuration of the sensor unit.

FIG. 4 is a block diagram of a configuration of the sensor unit 11. As shown in FIG. 4, an output signal from a sensor A 11*ca* is shaped by a waveform shaping circuit 11*da* and then inputted to an A/D (analog/digital) converter 11*e*. An output signal from a sensor B 11*cb* is shaped by a waveform shaping circuit 11*db* and then inputted to the A/D (analog/digital) converter 11*e*.

Similarly, an output signal from a sensor C 11*cc* is shaped by a waveform shaping circuit 11*dc* and then inputted to the A/D (analog/digital) converter 11*e*. The A/D converter 11*e* outputs the signal values to the sensor-value input unit 12 as digital data. While the three sensors are shown in FIG. 4, the number of sensors is not particularly limited.

The sensor-value input unit 12 outputs the sensor values received from the sensor unit 11 to the judging unit 13*e* of the control unit 13. When coins are practically flowed through the coin recognizing device 10 to newly generate the main judgment frame 14*a*, the sensor-value input unit 12 also outputs the sensor values to the main-judgment-frame registration unit 13*a* of the control unit 13. When the auxiliary judgment frame 14*b* or the reject judgment frame 14*c* is to be generated by flow of coins, the sensor-value input unit 12 also can output the sensor values to the auxiliary-judgment-frame registration unit 13*b* or the reject-judgment-frame registration unit 13*c* of the control unit 13.

The control unit 13 is a processor that performs a process of registering the judgment frames (the main judgment frame 14*a*, the auxiliary judgment frame 14*b*, and the reject judgment frame 14*c*) corresponding to each denomination in the memory unit 14, and also performs a denomination judging process using the judgment frames. The control unit 13 is also a processor that, when a plurality of the auxiliary judgment frames 14*b* or a plurality of the reject judgment frames 14*c* are registered for a specific denomination, performs a process of reducing a memory area for the judgment frames by integrating the judgment frames overlapped.

The main-judgment-frame registration unit 13*a* is a processor that performs a process of generating the main judgment frame 14*a* for each denomination to be recognized by the coin recognizing device 10 based on the output from the sensor-value input unit 12 obtained when coins associated with a specific denomination are flowed, and registering the generated main judgment frame 14*a* in the memory unit 14. The main-judgment-frame registration unit 13*a* is also a processor that performs a process (an overlap correction process) of performing an overlap check (a lap check) for the main judgment frames 14*a* corresponding to respective denominations, and performing correction so that the relevant main judgment frames 14*a* do not overlap with each other.

In the present embodiment, the example where the main judgment frame 14*a* is generated by practically flowing coins in judgment frame generation is explained. However, the main judgment frame 14*a* that is generated by any other coin recognizing devices 10 or an external device can be registered in the memory unit 14*a* through the main-judgment-frame registration unit 13*a*.

An example of the main judgment frame 14*a* is explained with reference to FIG. 5. FIG. 5 is one example of the main judgment frame 14*a*. As shown in FIG. 5, the main judgment frame 14*a* is data in a table form (a row/column form), for example. As many "higher limits" indicating higher limit values and "lower limits" indicating lower limit values in value ranges of elements as the elements are defined in a "column" direction of the table. Data in a row shown in FIG. 5 correspond to each denomination, and as many "rows" as the denominations are prepared in the table.

For example, in data of a first row corresponding to a denomination α, a higher limit of an element A is αAH and a lower limit thereof is αAL, a higher limit of an element B is αBH and a lower limit thereof is αBL, and a higher limit of an element C is αCH and a lower limit thereof is αCL. In data of a second row corresponding to a denomination β, a higher limit of the element A is βAH and a lower limit thereof is βAL, a higher limit of the element B is βBH and a lower limit thereof is βBL, and a higher limit of the element C is βCH and a lower limit thereof is βCL.

A procedure of defining the "higher limit" and the "lower limit" of each "element" shown in FIG. 5 is explained with reference to FIG. 6. FIG. 6 are examples of distribution of the sensor values. FIG. 6(1) depicts a case where a distribution of the sensor values is near a normal distribution, FIG. 6(2) depicts a case where a distribution of the sensor values is shifted toward the higher limit, and FIG. 6(3) depicts a case where a distribution of the sensor values is shifted toward the lower limit. Reference numeral 106*a* in FIG. 6 denotes a minimum value (MIN) in the distribution of the sensor values, 106*b* denotes a maximum value (MAX) thereof, and 106*c* denotes an average value (AVE) thereof.

To define the "higher limit" and the "lower limit" of each "element" shown in FIG. 5, a predetermined number (50, for example) of coins of a denomination corresponding to the main judgment frame 14*a* to be generated are first flowed through the coin recognizing device 10. A distribution state of the sensor values of each element such as the material, the diameter, and the thickness is then obtained through the sensor-value input unit 12. The main-judgment-frame registration unit 13*a* defines the "higher limit" and the "lower limit" of each element by using a statistical method.

Specifically, the maximum value (MAX) and the minimum value (MIN) are obtained for each element, and then the average value (AVE) is calculated. A difference (ΔH=MAX−AVE) between the maximum value and the average value, and a difference (ΔL=AVE−MIN) between the average value and the minimum value are then calculated. Whether the distribution is near the normal distribution or is a distribution shifted toward the higher or lower limit is judged based on a value (A=(ΔH−ΔL)/σ), which is obtained by dividing a difference between "ΔH" as a distribution on the higher limit side and "ΔL" as a distribution on the lower limit side by a standard deviation σ, then defining the "higher limit" and the "lower limit" of each element.

For example, when "$-2 \leq A \leq 2$", it is considered that the distribution has a profile close to the normal distribution (see FIG. 6(1)), and therefore the higher limit is defined as "AVE+5σ" and the lower limit is defined as "AVE−5σ". When "$A<2$", it is considered that the distribution has a profile broader on the lower limit side (see FIG. 6(2)), and therefore the higher limit is defined as "AVE+3σ" and the lower limit is defined as "AVE−7σ". When "$A>2$", it is considered that the distribution has a profile broader on the higher limit side (see FIG. 6(3)), and therefore the higher limit is defined as "AVE+7σ" and the lower limit is defined as "AVE−3σ".

The main judgment frame 14*a* corresponding to a specific denomination is generated (corresponding to each row in FIG. 5) by performing the defining process for the higher and lower limits with respect to all the elements. The table as shown in FIG. 5 is generated by performing the same process also for other denominations.

When the main judgment frame 14*a* corresponding to each denomination is generated, the main-judgment-frame registration unit 13*a* performs the overlap check (the lap check) of the main judgment frame 14*a* corresponding to each denomination. An overview of the overlap check (the lap check) is explained below with reference to FIG. 5 already shown. In the overlap check (the lap check), whether value ranges (ranges between the higher and lower limits) of respective elements for each denomination overlap with each other is checked.

For example, in the overlap check for the denominations α and β with respect to the element A, it is assumed that a condition 1 is defined as "αAH−βAL>0" and "αAL−βAH>0", and a condition 2 is defined as "αAH−βAL<0" and "αAL−βAH<0". When the condition 1 or 2 is satisfied, it is judged that "the denominations α and β have no overlapped area in the element A". When neither the condition 1 nor 2 is satisfied, it is judged that "the denominations α and β have an overlapped area in the element A".

When the judgment is performed for all the elements and then it is judged that "there is no overlapped area" in at least one of the elements, both of the relevant denominations do not become targets for the overlap correction process. When it is judged that "there is an overlapped area" in all the elements, both of the relevant denominations are handled as targets for the overlap correction process. While the overlap check for the denominations α and β has been explained here, the overlap check is performed for all pairs of denominations. In the example shown in FIG. 5, the overlap checks for the denominations α and β, the denominations α and γ, and the denominations β and γ are performed.

A process of performing correction (an overlap correction process) to prevent overlap of the main judgment frames 14*a* that have been judged "there is an overlapped area" in all the elements as a result of the overlap check (the lap check) is explained. An example in which the denominations α and β shown in FIG. 5 are judged that "there is an overlapped area" in all the elements is explained below.

In this example, a difference of the average values of the sensor value distributions with respect to the elements is divided by a sum of the standard deviations (σ) of the sensor value distributions with respect to the elements, and an absolute value of the resultant is calculated as a value (TH). One of the elements having a largest TH is selected as an element for a correction target. Here, TH is expressed by "TH=ABS ((AVE of the denomination α−AVE of the denomination β)/(σ of the denomination α+σ of the denomination β))", where "ABS" indicates an absolute value.

Upon determination of the element as the correction target, the overlap correction process is then performed. An example in which the "element A" shown in FIG. 5 is selected as the correction target, and the average value (AVE) of the sensor value distribution with respect to the element A of the denomination α is larger than the average value (AVE) of the sensor value distribution with respect to the element A of the denomination β is explained.

In this example, "X" obtained by an expression "X=AVE of the denomination α−TH×σ of the denomination α" is set as the "lower limit" of the element A in the denomination α, and "X−1" is set as the "higher limit" of the element A of the denomination β. In this way, the main judgment frame 14*a* corresponding to each denomination is adjusted to prevent the value range for at least one of the elements from overlapping with the value ranges of the other elements.

The auxiliary-judgment-frame registration unit 13*b* is explained next. The auxiliary-judgment-frame registration unit 13*b* is a processor that performs a process of registering, in the memory unit 14, the auxiliary judgment frame 14*b* as a judgment frame for passing coins that are rejected by the main judgment frame 14*a* but are originally not to be rejected. When the "higher limit" or the "lower limit" of a specific element of the main judgment frame 14*a* is corrected in the overlap correction process by the main-judgment-frame registration unit 13*a*, the auxiliary-judgment-frame registration unit 13*b* also performs a process of automatically generating the auxiliary judgment frame 14*b* for judging data of both denominations included in the ranges before the correction to be the corresponding denominations, respectively.

Figure 7:
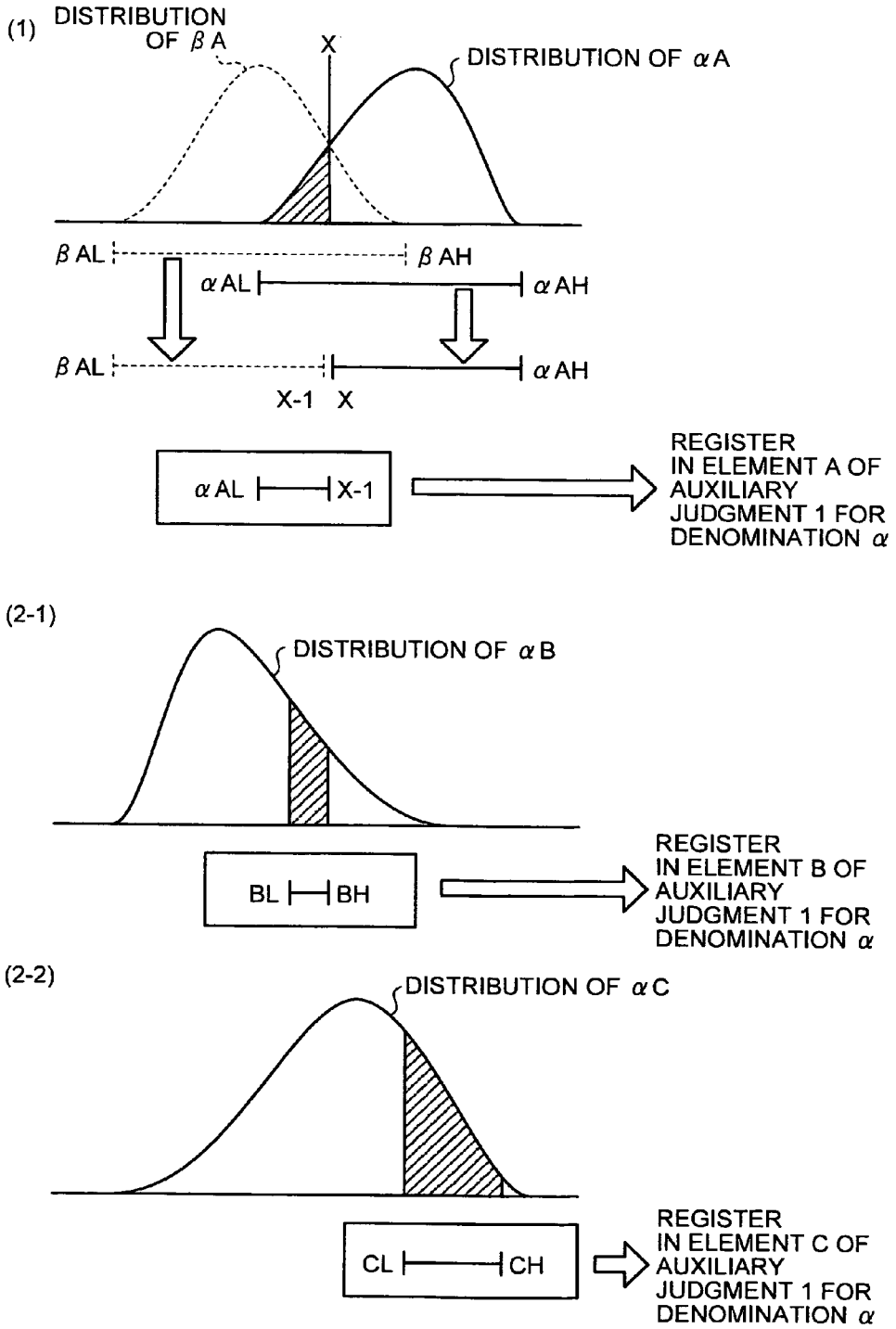
FIG. 7 depicts an overview of an automatic generating process for an auxiliary judgment frame associated with an overlap correction of the main judgment frame.

An overview of an automatic generating process for the auxiliary judgment frame 14*b* associated with the overlap correction of the main judgment frame 14*a* is explained with reference to FIG. 7. FIG. 7 depicts the overview of the automatic generating process for the auxiliary judgment frame 14*b* associated with the overlap correction of the main judgment frame 14*a*. In FIG. 7, symbols such as "αAH" and "βAH" corresponding to the items of the table shown in FIG. 5 are used.

When a distribution of the element A of the denomination α (the distribution of αA shown in FIG. 7(1)) and a distribution of the element A of the denomination β (the distribution of βA shown in FIG. 7(1)) partially overlap with each other and are selected as targets of the overlap correction process by the main-judgment-frame registration unit 13*a* as shown in FIG. 7(1), the lower limit of the denomination α is set to "X" based on the value of "X" above mentioned. The value range of the element A of the denomination α is changed to between the lower limit "X" to the higher limit "αAH". The higher limit of the denomination β is set to "X−1", and the value range of the element A of the denomination β is changed to between the lower limit "βAL" and the higher limit "X−1".

In this example, a part (a shaded area in FIG. 7(1)) excluded from the value range of the element A of the denomination α due to the change to the new lower limit "X", that is, a value range from the lower limit "αAL" to the higher limit "X−1" is registered for the element A of an auxiliary judgment 1 of the denomination α (see FIG. 8 explained later). It is also searched how data of a coin corresponding to each of data that have been distributed in the shaded area in FIG. 7(1) is distributed in other elements of the denomination α.

For example, as for data of the element B the denomination α, when data of the coins are included in the shaded area of FIG. 7(1) with respect to the element A and are distributed as shown in a shaded area of FIG. 7(2-1) with respect to the element B, a lower limit (BL) and a higher limit (BH) of the shaded area are registered for the element B of the auxiliary judgment 1 of the denomination α. As for the element C of the denomination α, when data of the coins are distributed in the shaded area of FIG. 7(1) with respect to the element A and are included as shown in a shaded area of FIG. 7(2-2) with respect to the element C, a lower limit (CL) and a higher limit (CH) of the shaded area are registered for the element C of the auxiliary denomination 1 of the denomination α. The search process is performed for all the elements.

The auxiliary-judgment-frame registration unit 13*b* also performs a process of additional registration of judgment conditions predetermined for the auxiliary judgment frame 14*b* when the overlap correction of the main judgment frame 14*a* is performed, in addition to the automatic generating process of the auxiliary judgment frame 14*b*. For example, genuine coins that are practically rejected by the main judgment frame 14*a* corresponding to a specific denomination are flowed, and data (reject data) including the sensor values from the sensor-value input unit 12 are obtained. A value range of each element in the data is then calculated and registered in the table shown in FIG. 8. When a new judgment condition is to be added to the auxiliary judgment frame 14*a*, and when a value obtained by dividing a width of each value range (the higher limit-the lower limit) by a width of the value range in the main judgment frame 14*a* is larger than ¼, an alert can be issued.

The reject-judgment-frame registration unit 13*c* is explained next. The reject-judgment-frame registration unit 13*c* is a processor that performs a process of registering in the memory unit 14 the reject judgment frame 14*c* as a judgment frame for rejecting coins that are passed by the main judgment frame 14*a* or the auxiliary judgment frame 14*b* but are originally not to be passed. Examples of the auxiliary judgment frame 14*b* registered by the auxiliary-judgment-frame registration unit 13*b* and the reject judgment frame 14*c* registered by the reject-judgment-frame registration unit 13*c* are explained with reference to FIG. 8. FIG. 8 depicts examples of the auxiliary judgment frame 14*b* and the reject judgment frame 14*c*.

As shown in FIG. 8, the auxiliary judgment frame 14*b* and the reject judgment frame 14*c* are data in a table format similar to the main judgment frame 14*a* as shown in FIG. 5. In the frames 14*b* and 14*c*, "higher limit" indicating a higher limit value and "lower limit" indicating a lower limit value of each element with respect to each judgment rule (judgments 1, 2, and 3 shown in FIG. 8) are defined. In the auxiliary judgment frame 14*b* and the reject judgment frame 14*c*, a "valid flag" item is provided for each judgment rule, and only the judgment rules having the valid flag set at "ON" are used for the judgment. Provision of the valid flag item makes it possible to temporarily inhibit usage of a specific judgment rule, or to use only a predetermined judgment rule in a specific country.

The auxiliary judgment frame 14*b* and the reject judgment frame 14*c* shown in FIG. 8 correspond to the main judgment frame 14*a* related to a specific denomination. Conditions of coins that are rejected by the main judgment frame 14*a* but are originally to be passed are registered in the auxiliary judgment frame 14*b*, and conditions of coins that are passed by the main judgment frame 14*a* or the auxiliary judgment frame 14*b* but are originally to be rejected are registered in the reject judgment frame 14*c*. In this way, denomination judgment can be performed flexibly by holding the auxiliary judgment frame 14*b* and the reject judgment frame 14*c* separately from the main judgment frame 14*a*.

Figure 9:
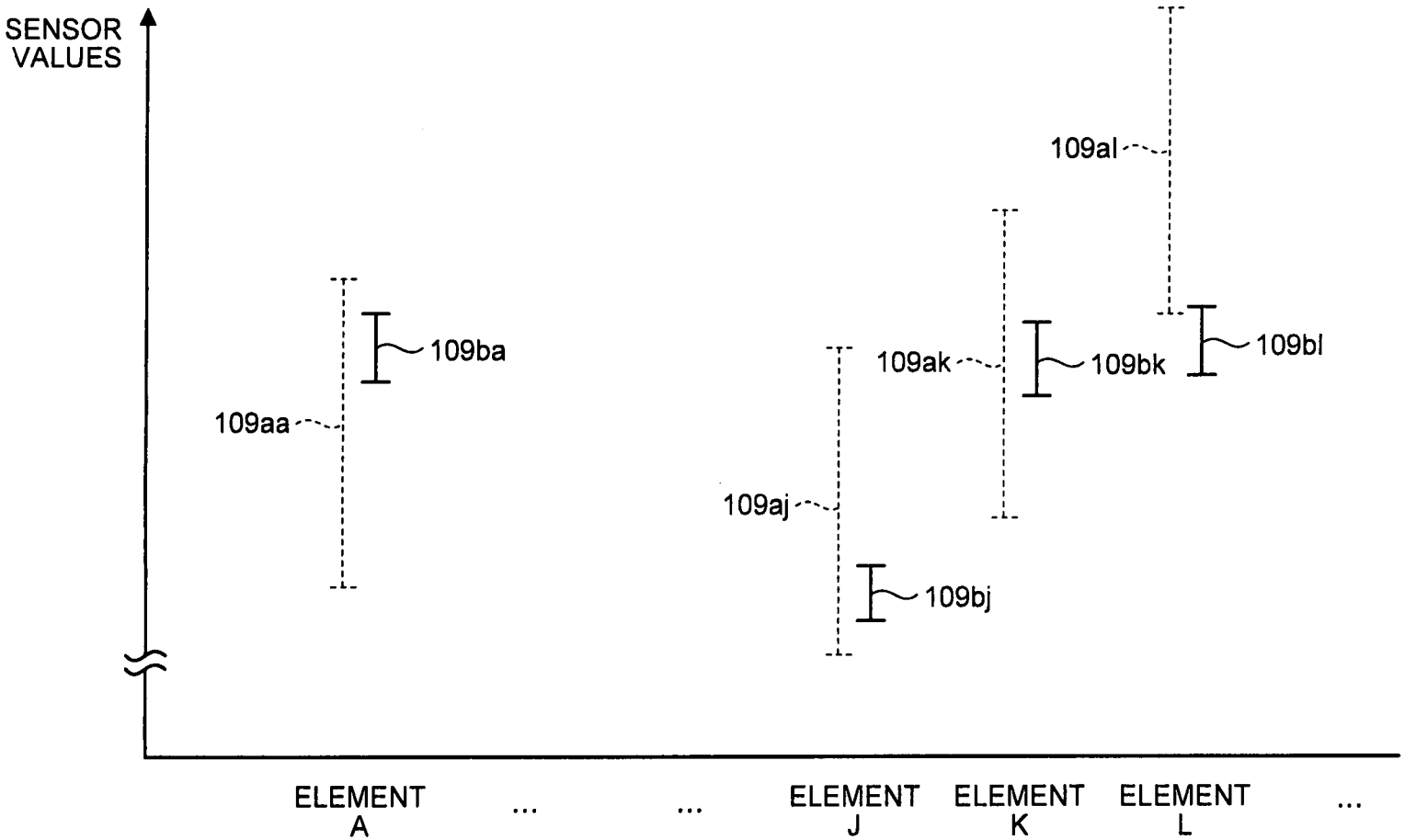
FIG. 9 is an example of a relation between the main judgment frame and the auxiliary judgment frame.

An example of a relation between the main judgment frame 14*a* and the auxiliary judgment frame 14*b*, and an example of a relation between the main judgment frame 14*a* and the reject judgment frame 14*c* are explained with reference to FIGS. 9 and 10. FIG. 9 is an example of the relation between the main judgment frame 14*a* and the auxiliary judgment frame 14*b*. Reference numerals 109*aa*, 109*aj*, 109*ak*, and 109*al* in FIG. 9 denote value ranges of respective elements of the main judgment frame 14*a*, and 109*ba*, 109*bj*, 109*bk*, and 109*bl* in FIG. 9 denote value ranges of the respective elements of the auxiliary judgment frame 14*b*.

In the example shown in FIG. 9, all the value ranges of the auxiliary judgment frame 14*b* are included in the value ranges of the main judgment frame 14*a*, except for 109*bl* corresponding to an element L. Judgment conditions for coins that are rejected because a predetermined element (the element L in FIG. 9) is not included in the main judgment frame 14*a* but that are originally to be passed are registered in the auxiliary judgment frame 14*b*. In this way, cases where the pass rate of genuine coins is reduced due to a long circulation period or the like can be flexibly handled.

Figure 10:
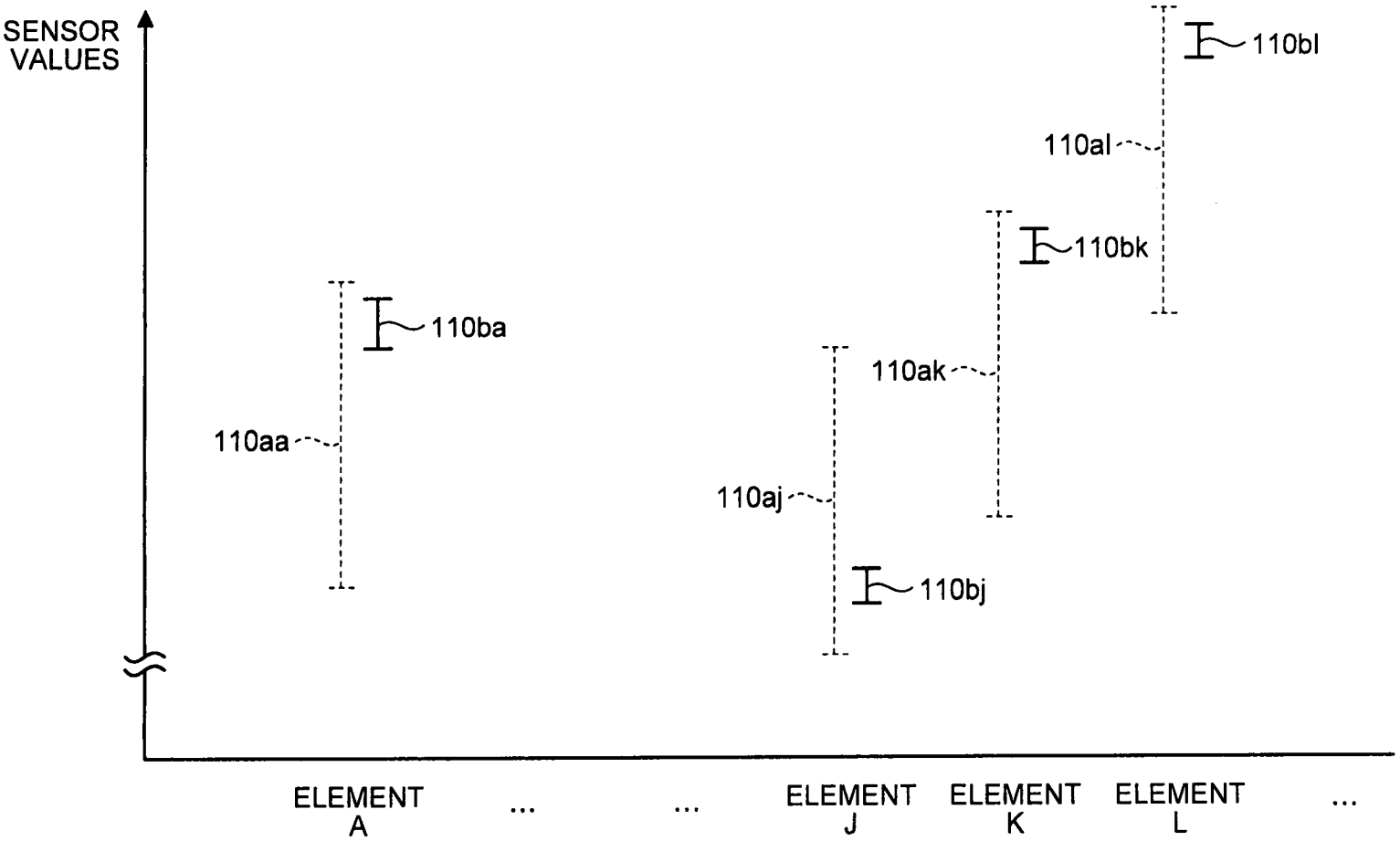
FIG. 10 is an example of a relation between the main judgment frame and the reject judgment frame.

FIG. 10 is an example of the relation between the main judgment frame 14*a* and the reject judgment frame 14*c*. Reference numerals 110*aa*, 110*aj*, 110*ak*, and 110*al* shown in FIG. 10 denote value ranges of respective elements of the main judgment frame 14*a*, and 110*ba*, 110*bj*, 110*bk*, and 110*bl* shown in FIG. 10 denote value ranges of the respective elements of the reject judgment frame 14*c*.

In the example shown in FIG. 10, all the value ranges of the reject judgment frame 14*c* are included in the value ranges of the main judgment frame 14*a*; however, they are narrower than the value ranges of the main judgment frame 14*a*. This reject judgment frame 14*c* is used to reject coins that fall within the value ranges of all the elements in the main judgment frame 14*a* and satisfy specific conditions. That is, the reject judgment frame 14*c* is used to reject coins that are passed by the main judgment frame 14*a* but are originally not to be passed. The reject judgment frame 14*c* is also used to reject coins that are passed by the auxiliary judgment frame 14*b* but are originally not to be passed.

As described above, the judgment conditions for counterfeit coins or similar coins of other countries of which data are passed because all the elements of the main judgment frame 14*a* are satisfied but are originally to be rejected are registered in the reject judgment frame 14*c*. In this way, an increase in the number of reject targets due to appearance of new counterfeit coins or the like can be flexibility addressed.

The judgment-frame integration unit 13*d* is explained next. The judgment-frame integration unit 13*d* is a processor that performs an "integration" process when a plurality of judgment frames (see the judgments 1, 2, and the like in FIG. 8) are registered in the auxiliary judgment frame 14*b* or the reject judgment frame 14*c* to integrate the judgment frames overlapped to reduce the judgment conditions. The "integration" is performed with respect to setting of the judgment frames in the same element. When the judgment frames are integrated in this way, a memory area in which the judgment frames are stored can be reduced, and the judging process can be speeded up.

The judgment-frame integration process performed by the judgment-frame integration unit 13*d* is explained with reference to FIG. 11. FIG. 11 is an explanatory diagram of integration of the judgment frames. In FIG. 11, the auxiliary judgment frame 14*b* is shown in which higher and lower limits of the element A in a judgment 1 are denoted by "1AH" and "1AL", and higher and lower limits of the element B in the judgment 1 are denoted by "1BH" and "1BL", respectively. Higher and lower limits of the element A in a judgment 2 are denoted by "2AH" and "2AL", and higher and lower limits of the element B in the judgment 2 are denoted by "2BH" and "2BL", respectively.

In the judgment-frame integration process, it is judged whether the judgment conditions (the judgments 1, 2, and the like) can be regarded as a same distribution in units of elements. When it is judged that the judgment conditions can be regarded as the same distribution, these judgment conditions are integrated into one judgment condition. Specifically, it is judged which one of "(1) either value range is included in the other", "(2) the value ranges are overlapped (lapped) with each other", and "(3) the value ranges are next to each other" is met by the value ranges of each element in the judgment conditions to be compared with each other. When the conditions (1) to (3) are met with respect to all the elements, the judgment conditions are integrated.

To judge whether "(1) either value range is included in the other", data of a judgment 3 and data of the judgment 2 are compared with each other with respect to the element A, for example. When either "3AH−2AH≥0" and "2AL−3AL≥0" or "3AH−2AH≤0" and "2AL−3AL≤0" is satisfied, it is judged that the condition (1) is met.

To judge whether "(2) the value ranges are overlapped (lapped) with each other", the data of the judgment 3 and the data of the judgment 2 are compared with each other with respect to the element A, for example. When either "3AL<2AL<3AH" or "3AL<2AH<3AH" is satisfied, it is judged that the condition (2) is met.

To judge whether "(3) the value ranges are next to each other", the data of the judgment 3 and the data of the judgment 2 are compared with each other with respect to the element A, for example. When either "3AH=2AL" or "2AH=3AL" is satisfied, it is judged that the condition (3) is met.

In the judgment-frame integration process, the comparison is performed in the order from the largest judgment number in the table (in descending order of the number). For example, in the case shown in FIG. 11, the judgments 3 and 2 are compared with each other, and then the judgments 2 and 1 are compared with each other. In both judgment conditions where the conditions (1) to (3) are met with respect to all the elements, the higher and lower limits of each element are integrated to update the judgment condition having a smaller judgment number, and the judgment condition having a larger judgment number is deleted from the table. This comparison is repeated until a judgment condition having a smallest judgment number becomes a comparison criterion.

The integration of the higher and lower limits of each element is performed in the following procedure. For example, when the judgment 2 and 3 are to be integrated, a largest one of 2AH, 2AL, 3AH, and 3AL, which are the higher and lower limits of the element A is regarded as a new higher limit, and a smallest one is regarded as a new lower limit. The integration of the higher and lower limits is performed for all the elements to generate a new judgment 2, and the judgment 3 is deleted.

Figure 12:
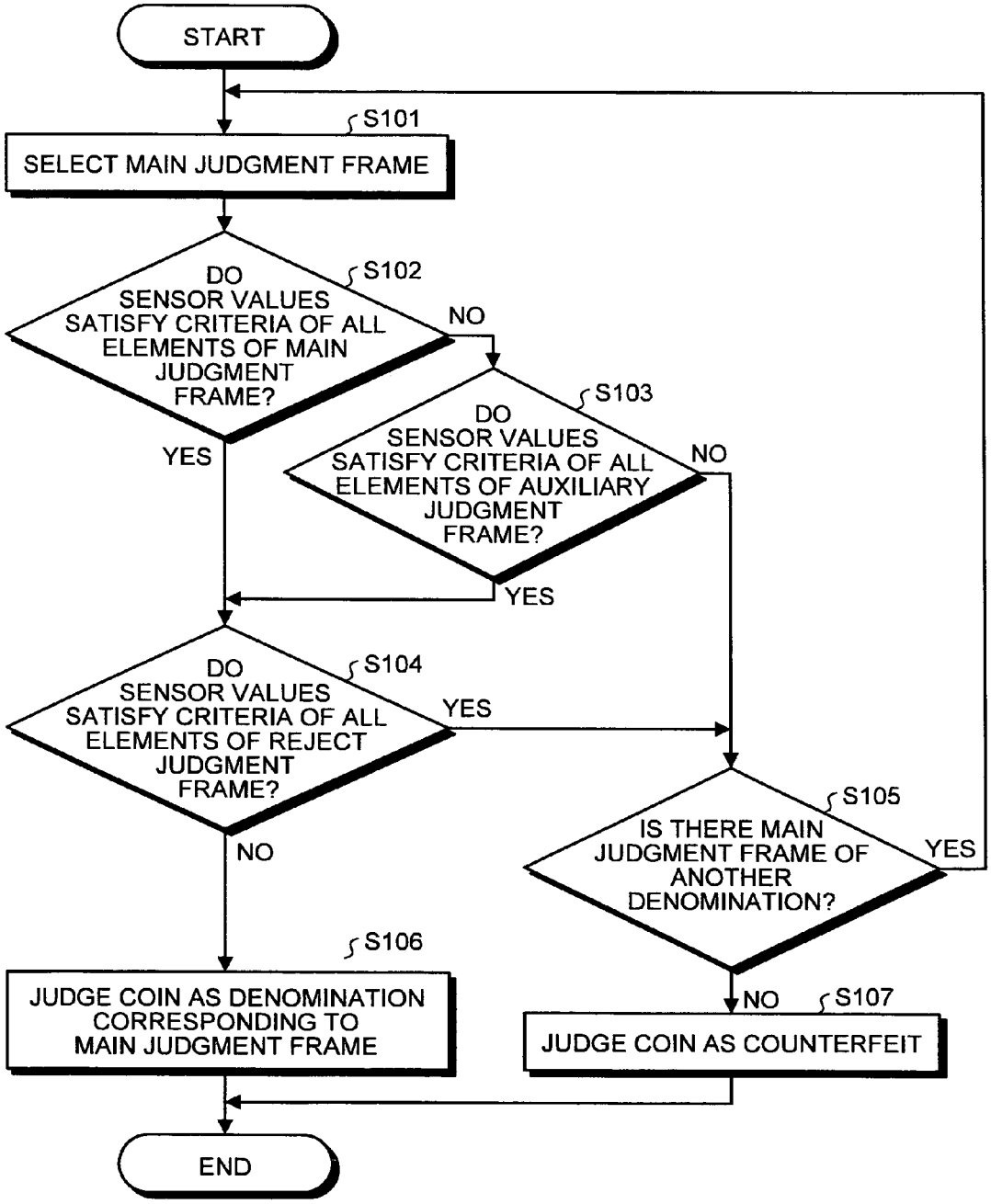
FIG. 12 is a flowchart of a process procedure performed by a judging unit.

The judging unit 13*e* is explained next. The judging unit 13*e* is a processor that performs a process of judging a denomination of a coin by using the main judgment frame 14*a*, the auxiliary judgment frame 14*b*, and the reject judgment frame 14*c* corresponding to each denomination registered in the memory unit. A judging process performed by the judging unit 13*e* is explained with reference to FIG. 12. FIG. 12 is a flowchart of a process procedure performed by the judging unit 13*e*. Prior to Step S101 in FIG. 12, a denomination is roughly judged by using a diameter sensor, a wide judgment frame, and the like.

As shown in FIG. 12, the judging unit 13*e* selects the main judgment frame 14*a* corresponding to a certain denomination (Step S101), and judges whether sensor values of a coin as a judgment target satisfy the criteria of all the elements of the main judgment frame 14*a* (Step S102). When the sensor values satisfy the criteria of all the elements of the main judgment frame 14*a* (YES at Step S102), the judging unit 13*e* judges whether the sensor values satisfy the criteria of all the elements of the reject judgment frame 14*c* associated with the main judgment frame 14*a* (Step S104).

When the sensor values do not satisfy the criteria of at least one of the elements of the reject judgment frame 14*b* (NO at Step S104), the judging unit 13*e* judges that the coin as the judgment target is of a denomination corresponding to the main judgment frame 14*a* selected at Step S101 (Step S106), and ends the process. When the sensor values satisfy the judgment conditions at Step S104 (YES at Step S104), a process at Step S105 is performed.

When the sensor values do not satisfy the judgment conditions at Step S102 (NO at Step S102), it is judged whether the sensor values satisfy the criteria of all the elements of the auxiliary judgment frame 14*b* associated with the main judgment frame 14*a* (Step S103). When the sensor values satisfy the criteria of all the elements of the auxiliary judgment frame 14*b* (YES at Step S103), the process at Step S104 and the subsequent processes are performed.

On the other hand, when the sensor values do not satisfy the judgment conditions at Step S103 (NO at Step S103), it is judged whether there is the main judgment frame 14*a* of any other denominations (Step S105). When there is the main judgment frame 14*a* of any other denominations (YES at Step S105), the processes from Step S101 are repeated by using the main judgment frame 14*a* of the new denomination. When the sensor values do not satisfy the judgment conditions at Step S105 (NO at Step S105), the coin as the judgment target is judged as a counterfeit coin (Step S107), and the process is ended.

In the flowchart shown in FIG. 12, because the denomination of the coin is previously judged roughly by using the diameter sensor, the wider judgment frame, and the like prior to Step S101, the coin is judged as counterfeit at Step S107. However, when the denomination is not previously judged roughly, it is possible to judge at Step S107 that there is no corresponding denomination.

The memory unit 14 is explained next. The memory unit 14 includes a memory device such as a RAM (Random Access Memory) or an HDD (Hard Disk Drive), and stores therein the main judgment frame 14*a* for each denomination, and the auxiliary judgment frame 14*b* and the reject judgment frame 14*c* associated with the main judgment frame 14*a* of the predetermined denomination. The main judgment frame 14*a* has been explained with reference to FIG. 5 and the like, and the auxiliary judgment frame 14*b* and the reject judgment frame 14*c* have been explained with reference to FIG. 8. Therefore, explanations thereof will be omitted.

As described above, the coin recognizing device is configured in this embodiment. The main-judgment-frame registration unit registers the main judgment frame for each denomination having the value ranges adjusted so that the value range corresponding to data of at least one recognition element does not overlap with the value ranges corresponding to the same recognition element of other denominations. The auxiliary-denomination-frame registration unit registers the auxiliary judgment frame for each denomination, which is the value range of each recognition element with respect to a coin that does not fall into the main judgment frame but is to be judged as a specific denomination. The reject-judgment-frame registration unit registers the reject judgment frame for each denomination, which is the value range of each recognition element with respect to a coin that falls into the main judgment frame or the auxiliary judgment frame but is not to be judged as a specific denomination. The judging unit judges a coin that falls into either the main judgment frame or the auxiliary judgment frame but does not fall into the reject judgment frame as a coin corresponding to the main judgment frame.

Accordingly, by using the auxiliary judgment frame for passing coins that are rejected by the main judgment frame but are originally not to be rejected, and the reject judgment frame for rejecting coins that are not rejected by the main judgment frame or the auxiliary judgment frame but are originally to be rejected, coins of various countries can be handled, and addition or change of recognition targets can be flexibly addressed.

Industrial Applicability

As described above, the coin recognizing device and the coin recognizing method according to the present invention are useful in judgment of denominations or authentication of coins, and particularly suitable for cases where coins of various countries are to be handled, or addition or change of recognition targets are to be flexibly addressed.

The invention claimed is:

1. A coin recognizing device for recognizing a coin based on whether data of a plurality of recognition elements of the coin according to sensor outputs are included in predetermined value ranges, respectively, the coin recognizing device comprising:

a main-judgment-frame registration unit for registering a main judgment frame for each denomination including the value ranges that are corrected so that the value range corresponding to at least one of the recognition elements of the denomination does not overlap with the value range corresponding to the same recognition element of any other denominations;

an auxiliary-judgment-frame registration unit for registering an auxiliary judgment frame for a specific denomination including the value ranges of the recognition elements for a coin of which data does not fall within the main judgment frame for the specific denomination but is to be judged as that of the specific denomination; and a judging unit for judging a coin of which data falls within the main judgment frame or the auxiliary judgment frame as a coin of a denomination corresponding to the main judgment frame.

2. A coin recognizing device for recognizing a coin based on whether data of a plurality of recognition elements of the coin according to sensor outputs are included in predetermined value ranges, respectively, the coin recognizing device comprising:

a main-judgment-frame registration unit for registering a main judgment frame for each denomination including the value ranges that are corrected so that the value range corresponding to at least one of the recognition elements does not overlap with the value range corresponding to the same recognition element of any other denominations;

a reject-judgment-frame registration unit for registering a reject judgment frame for a specific denomination including the value ranges of the recognition elements of a coin of which data falls within the main judgment frame for the specific denomination but that is not to be judged as that of the specific denomination; and a judging unit for judging a coin of which data falls within the main judgment frame and does not fall within the reject judgment frame as a coin of a denomination corresponding to the main judgment frame.

3. A coin recognizing device for recognizing a coin based on whether data of a plurality of recognition elements of the coin according to sensor outputs are included in predetermined value ranges, respectively, the coin recognizing device comprising:

a main-judgment-frame registration unit for registering a main judgment frame for each denomination including the value ranges that are corrected so that the value range corresponding to a distribution of data of at least one of the recognition elements does not overlap with the value range corresponding to that of the same recognition element of any other denominations;

an auxiliary-judgment-frame registration unit for registering an auxiliary judgment frame for a specific denomination including the value ranges of the recognition elements for a coin of which data does not fall within the main judgment frame for the specific denomination but that is to be judged as a coin of the specific denomination;

a reject-judgment-frame registration unit for registering a reject judgment frame for the specific denomination including the value ranges of the recognition elements for a coin of which data falls within the main judgment frame for the specific denomination or the auxiliary judgment frame for the specific denomination but that is not to be judged as a coin of the specific denomination; and a judging unit for judging a coin of which data falls within either the main judgment frame or the auxiliary judgment frame and does not fall within the reject judgment frame as a coin of a denomination corresponding to the main judgment frame.

4. The coin recognizing device according to claim 1, wherein when all of the value ranges corresponding to respective recognition elements of a specific denomination overlap with all of the respective value ranges corresponding to the same respective recognition elements of any other denominations, the main-judgment-frame registration unit selects one recognition element of which the data distributions are the most distant from each other between the specific denomination and any of the overlapping denomination, and corrects the value range of the recognition element selected so that the value ranges of the selected recognition element of the overlapping denominations do not overlap each other.

5. The coin recognizing device according to claim 1, wherein, when the value range corresponding to a specific recognition element of a specific denomination has been corrected by the main-judgment-frame registration unit not to overlap with the value range corresponding to the same recognition element of any other denominations, the auxiliary-judgment-frame registration unit registers the auxiliary judgment frames for specific coins of the specific denomination of which data corresponding to the specific recognition element were included in a first value range overlapped before the correction, such that the auxiliary judgment frames have the first value range of the specific recognition element and respective value ranges of other recognition elements than the specific recognition element of the specific coins.

6. The coin recognizing device according to claim 3, wherein the auxiliary-judgment-frame registration unit is capable of registering a plurality of the auxiliary judgment frames for each denomination, and the reject-judgment-frame registration unit is capable of registering a plurality of the reject judgment frames for each denomination.

7. The coin recognizing device according to claim 6, wherein, when the plural auxiliary judgment frames or the plural reject judgment frames are registered for a denomination, the auxiliary judgment frames or the reject judgment frames are compared with each other among the same kind of the judgment frames, and when value ranges corresponding to any recognition element have an overlapped part of data or are next to each other with respect to each of all the recognition elements, integration is performed to combine relevant judgment frames into one judgment frame having a continuous value range.

8. A coin recognizing method for recognizing a coin based on whether data of a plurality of recognition elements according to sensor outputs are included in predetermined value ranges, respectively, the coin recognizing method comprising:

registering a main judgment frame for each denomination including the value ranges that are corrected so that the value range corresponding to at least one of the recognition elements does not overlap with the value range corresponding to the same recognition element of any other denominations;

registering an auxiliary judgment frame for a specific denomination including the value ranges of the recognition elements for a coin of which data does not fall within the main judgment frame for the specific denomination but that is to be judged as a coin of the specific denomination; and judging a coin of which data falls within the main judgment frame or the auxiliary judgment frame as a coin of a denomination corresponding to the main judgment frame.

9. A coin recognizing method for recognizing a coin based on whether data of a plurality of recognition elements according to sensor outputs are included in predetermined value ranges, respectively, the coin recognizing method comprising:

registering a main judgment frame for each denomination including the value ranges that are corrected so that the value range corresponding to at least one of the recognition elements does not overlap with the value range corresponding to the same recognition element of any other denominations;

registering a reject judgment frame for a specific denomination including the value ranges of the recognition elements for a coin of which data falls within the main judgment frame for the specific denomination but that is not to be judged as a coin of the specific denomination; and judging a coin of which data falls within the main judgment frame and does not fall within the reject judgment frame as a coin of a denomination corresponding to the main judgment frame.

10. A coin recognizing method for recognizing a coin based on whether data of a plurality of recognition elements according to sensor outputs are included in predetermined value ranges, respectively, the coin recognizing method comprising:

registering a main judgment frame for each denomination including the value ranges that are corrected so that the value range corresponding to at least one of the recognition elements does not overlap with the value range corresponding to the same recognition element of any other denominations;

registering an auxiliary judgment frame for a specific denomination including the value ranges of the recognition elements for a coin of which data does not fall within the main judgment frame for the specific denomination but that is to be judged as a coin of the specific denomination;

registering a reject judgment frame for the specific denomination including the value ranges of the recognition elements for a coin of which data falls within the main judgment frame for the specific denomination or the auxiliary judgment frame for the specific denomination but that is not to be judged as a coin of the specific denomination; and judging a coin of which data falls within either the main judgment frame or the auxiliary judgment frame and does not fall within the reject judgment frame as a coin of a denomination corresponding to the main judgment frame.

11. The coin recognizing device according to claim 2, wherein when all of the value ranges corresponding to respective recognition elements of a specific denomination overlap with all of the respective value ranges corresponding to the same respective recognition elements of any other denominations, the main-judgment-frame registration unit selects one recognition element of which the data distributions are the most distant from each other between the specific denomination and any of the overlapping denomination, and corrects the value range of the recognition element selected so that the value ranges of the selected recognition element of the overlapping denominations do not overlap each other.

12. The coin recognizing device according to claim 3, wherein when all of the value ranges corresponding to respective recognition elements of a specific denomination overlap with all of the respective value ranges corresponding to the same respective recognition elements of any other denominations, the main-judgment-frame registration unit selects one recognition element of which the data distributions are the most distant from each other between the specific denomination and any of the overlapping denomination, and corrects the value range of the recognition element selected so that the value ranges of the selected recognition element of the overlapping denominations do not overlap each other.

13. The coin recognizing device according to claim 3, wherein, when the value range corresponding to a specific recognition element of a specific denomination has been corrected by the main-judgment-frame registration unit not to overlap with the value range corresponding to the same recognition element of any other denominations, the auxiliary-judgment-frame registration unit registers the auxiliary judgment frames for specific coins of the specific denomination of which data corresponding to the specific recognition element were included in a first value range overlapped before the correction, such that the auxiliary judgment frames have the first value range of the specific recognition element and respective value ranges of other recognition elements than the specific recognition element of the specific coins.

* * * * *